US005368055A

United States Patent [19]

Johnson et al.

[11] Patent Number: 5,368,055

[45] **Date of Patent: * Nov. 29, 1994**

[54] WINDPROOF UMBRELLA

[75] Inventors: Gary D. Johnson, New York; Stanley Hochfeld, Howard Beach, both of N.Y.

[73] Assignee: Leonard Holtz, Oceanside, N.Y. ; a part interest

[ * ] Notice: The portion of the term of this patent subsequent to Nov. 19, 2008 has been disclaimed.

[21] Appl. No.: 730,783

[22] PCT Filed: Feb. 9, 1990

[86] PCT No.: PCT/US90/00796

§ 371 Date: Jul. 24, 1991

§ 102(e) Date: Jul. 24, 1991

[87] PCT Pub. No.: WO90/09118

PCT Pub. Date: Aug. 23, 1990

Related U.S. Application Data

[63] Continuation-in-part of Ser. No. 309,620, Feb. 10, 1989, Pat. No. 4,979,534.

[51] Int. Cl.[5] ..... A45B 25/22

[52] U.S. Cl. ..... 135/33.7; 135/33.41

[58] Field of Search ..... 135/33.7, 33.71, 33.2, 135/33.4, 33.41

[56] References Cited

U.S. PATENT DOCUMENTS

| | | | |
|---|---|---|---|
| 617,415 | 1/1899 | Eatman . | |
| 1,031,974 | 7/1912 | Thomas . | |
| 1,145,768 | 7/1915 | Hartfiel . | |
| 1,581,843 | 4/1926 | Little | 135/33.71 |
| 1,785,561 | 12/1930 | Riley . | |
| 2,746,469 | 5/1956 | D'Andrea . | |
| 3,032,047 | 5/1962 | Wendorf . | |
| 3,456,661 | 7/1969 | Farley . | |
| 3,557,809 | 1/1971 | Vazquez . | |
| 3,863,660 | 2/1975 | Glaeser . | |
| 3,892,169 | 7/1975 | Jarnot . | |
| 3,960,162 | 6/1976 | Noel . | |
| 4,804,008 | 2/1989 | Ryder et al. . | |
| 4,979,534 | 12/1990 | Johnson et al. . | |
| 5,065,779 | 11/1991 | Johnson et al. . | |

FOREIGN PATENT DOCUMENTS

| | | | |
|---|---|---|---|
| 106457 | 5/1927 | Austria . | |
| 817056 | 8/1937 | France . | |
| 1284022 | 1/1962 | France . | |
| 1418948 | 10/1965 | France | 135/33.41 |
| 2687 | of 1858 | United Kingdom | 135/33.2 |

*Primary Examiner*—Henry E. Raduazo

*Attorney, Agent, or Firm*—Frishauf, Holtz, Goodman & Woodward

[57] ABSTRACT

A windproof umbrella includes a post (14); a plurality of ribs (18) extending outwardly in a radial direction from the upper end of the post; a lower canopy (20) secured on the ribs (18); a plurality of vent holes (34) therethrough; and an upper canopy (36) positioned on the lower canopy (20) and covering all lower vent holes (34). The upper canopy (36) is smaller than the lower canopy (20). Elastic fastening straps (48) secure the upper canopy (36) to the free end portions of the ribs (18) for permitting the upper canopy to elastically lift up responsive to wind. The upper canopy (36) may include at least one vent hole (76) closer to the free ends of the ribs (18) than the lower vent holes (34). A plurality of slits (44) extending inwardly from the outer edge of the upper canopy (36) may be provided, each slit (44) being in line with one rib (18). A channel forming member (57) may be secured to the lower canopy (20) in surrounding relation to each lower vent hole (44) for further preventing entry of water therethrough.

32 Claims, 9 Drawing Sheets

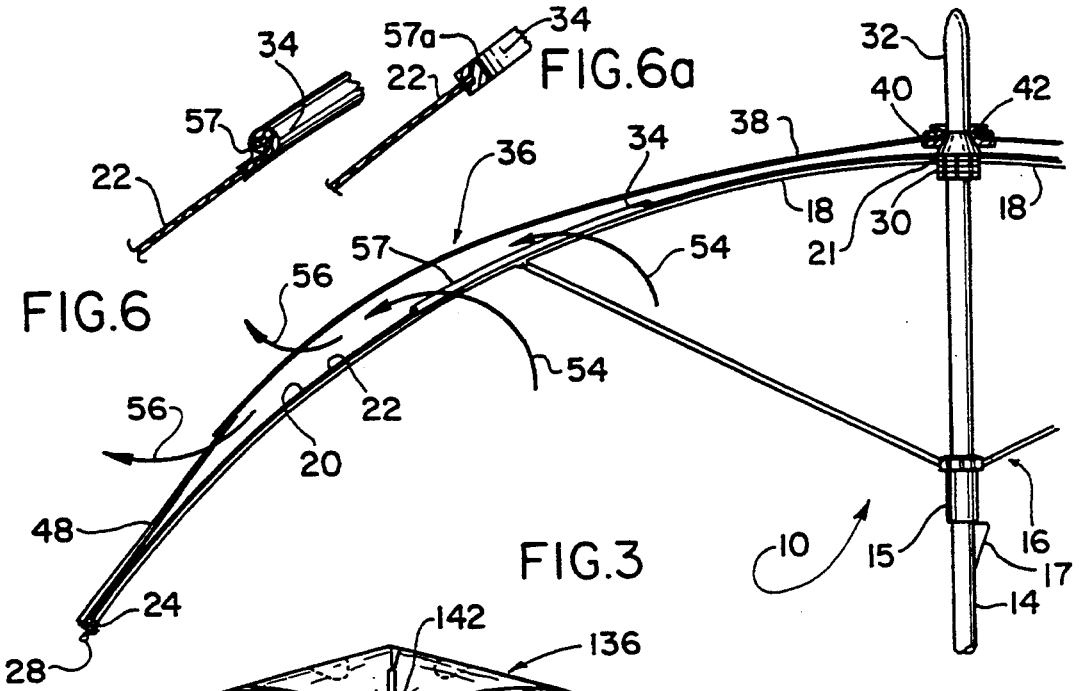
FIG.6
FIG.3
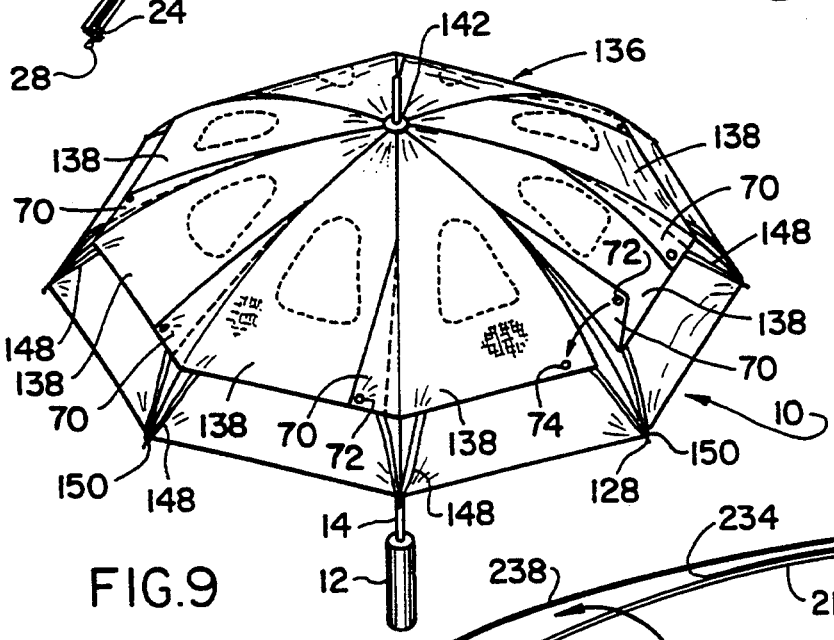
FIG.9
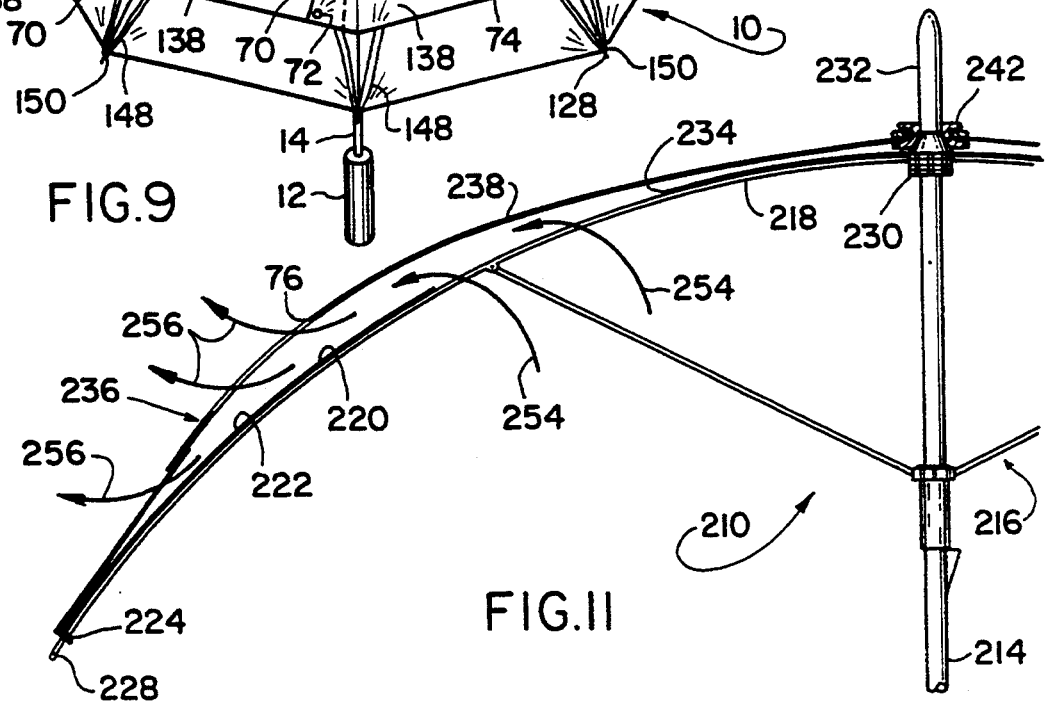
FIG.11

WINDPROOF UMBRELLA

This application is a continuation-in-part application of U.S. Ser. No. 07/309,620 filed 10 Feb. 1989, now U.S. Pat. No. 4,979,534 issued 25 Dec. 1990.

BACKGROUND OF THE INVENTION

This invention relates generally to umbrellas, and more particularly, is directed to an umbrella that is resistant to inversion from the wind.

Quite frequently, a wind will catch an umbrella user unaware and exert a force against the inner surface of the canopy which will cause the canopy to invert from its normal operable position to an upwardly convex or bowed position.

Accordingly, specially designed umbrellas for rainy, windy weather, have been proposed, as described, for example, in U.S. Pat. No. 3,032,047 to Wendorf. This patent discloses a storm umbrella with a canopy draped over the ribs and secured thereto and in which the canopy has a plurality of holes circumferentially arranged near the center thereof. A circular piece of fabric is disposed over the holes and is secured at spaced points to the ribs by stitching or the like. Accordingly, free passages for air exist underneath the unattached portions of the circular piece of fabric and through the holes in the fabric cover. However, this umbrella provides little resistance to inversion due to high winds. This is because the openings are provided at a radially inward position which is extremely close to the hub and therefore have a very small diameter. Furthermore, because the circular piece of fabric is stitched to the ribs, there is little flexibility thereof. Accordingly, the space between the canopy and the circular piece of fabric is very small and therefore provides a high resistance to wind exiting through the holes in the canopy. Still further, in extremely adverse weather conditions, a heavy rain may enter the space between the canopy and the circular piece of fabric and fall through the holes in the canopy onto the user. This is particularly the case where only a small circular piece of fabric is used to cover the canopy, as in U.S. Pat. No. 3,032,047. An umbrella which is similar in construction and therefore suffers from the same disadvantages is disclosed in U.S. Pat. No. 1,031,974 to Thomas.

A windproof umbrella is disclosed in U.S. Pat. No. 3,456,661 to Farley in which the main umbrella cover has a relatively large circular central opening concentric with the center pole and which may extend radially outwardly for a distance up to one-half of the dimensions of the radially oriented ribs. An upper umbrella covering comprised of a plurality of tapered, generally triangular gores 12 is positioned above the main umbrella covering and extends to a distance beyond the perimeter of the central hole thereof. Each gore is secured at its radial edges to the umbrella along the lines defined by two radially oriented ribs and has dimensions wider than the width between those ribs, the gores being secured either to the ribs or to the material of the main umbrella covering itself. Accordingly, a plurality of generally arcuate flying vents are formed which are adapted to fill with air rising from below through the central hole and expel the air horizontally when the radial ribs are rigidly held in position. When the air pressure above and below the umbrella is equalized, the flying vents are adapted to collapse and form a loose covering over the central hole of the main umbrella covering to thereby shed rain in the normal fashion. It is clear from this patent that, when the arcuate flying vents are filled with air, such as shown in the figures of the patent, inversion of the umbrella is prevented. However, this patent provides the disadvantage that rain can easily enter the central opening of the main umbrella covering when the flying vents are filled with air, and to this end, the windproof umbrella of this patent would not be practical.

Umbrellas of a similar nature are disclosed in French Patent Nos. 817,056 and 1,284,022. In addition to the remarks above, with these patents, the circular piece of fabric appears to be held in an arcuate position by rigid piping or the like.

U.S. Pat. No. 3,960,162 to Noel discloses a vented umbrella. With this umbrella, openings are formed in the covering material over each rib and a rigid pivoted vent is assembled with the struts over each opening. Accordingly, during heavy winds, a large wind pressure at the underside of the umbrella will pivotally raise the vents so as to exit through the openings. However, when the vents are pivotally opened, rain can enter therethrough.

U.S. Pat. No. 3,863,660 to Glaeser discloses a method and apparatus for controlling sunlight transmission and includes an umbrella having a lower canopy with a plurality of holes throughout the canopy. In such case, the openings permit some of the sunlight to pass therebetween to the user. If it is desired that no sunlight enter the umbrella, an outer canopy or covering may be employed in covering relation to the openings. In such case, the outer canopy has a plurality of holes around the peripheral edge thereof through which the free ends or tips of the ribs can extend for holding the outer canopy in place. However, the umbrella of this patent is not intended to be used against heavy winds and is merely used as a parasol to prevent sunlight from entering. In any event, the dimensions of the outer covering are identical to those of the main canopy so that, even if such umbrella was used in rainy, windy weather, it would be difficult to exhaust the air from the space between the inner and outer canopies.

Umbrellas in which two canopies, or a detachable canopy, has been used for aesthetic purposes or the like, are described in U.S. Pat. Nos. 1,145,768; 1,785,561; 2,746,469; and 3,557,809.

OBJECTS OF THE INVENTION

It is an object of the present invention to provide a windproof umbrella that overcomes the aforementioned problems with the prior art.

It is another object of the present invention to provide a windproof umbrella which prevents inversion of the umbrella during high winds.

It is still another object of the present invention to provide a windproof umbrella having a lower canopy with vent holes and an upper canopy in covering relation to the vent holes to provide air escape during high winds so as to prevent inversion of the umbrella.

It is yet another object of the present invention to provide such a windproof umbrella in which the upper canopy prevents rain from entering the vent holes in the lower canopy.

It is a further object of the present invention to provide such a windproof umbrella in which the upper canopy has dimensions smaller than those of the lower canopy so as to provide ready escape of air from the vent holes.

It is still a further object of the present invention to provide a windproof umbrella in which the upper canopy is held slightly taut on the lower canopy by elastic straps which can stretch during high winds.

It is yet a further object of the present invention to provide such a windproof umbrella in which the upper canopy is slit between sectors thereof from the peripheral edge extending approximately two thirds of the way towards the center thereof.

It is another object of the present invention to provide such a windproof umbrella in which the upper canopy has openings therein which are positioned radially outwardly of the vent holes in the lower canopy to provide additional escape of air from between the canopies.

It is still another object of the present invention to provide such a windproof umbrella in which the upper canopy is pivotally connected by a securing device to the free ends of the ribs.

It is yet another object of the present invention to provide such a windproof umbrella in which a bead or channel forming member is formed around the periphery of the vent holes in the lower canopy to prevent rain which may enter the space between the upper and lower canopies from falling through the vent holes.

The above and other objects, features and advantages of the present invention will become readily apparent from the following detailed description which is to be read in connection with the accompanying drawings.

SUMMARY OF THE INVENTION

In accordance with an aspect of the present invention, a windproof umbrella includes a post having a lower end to be grasped by a user and an opposite upper end; a plurality of ribs extending outwardly in a radial direction from the upper end of the post, each rib having a free end; a lower canopy secured in covering relation on the ribs, the lower canopy including at least one vent hole therethrough; an upper canopy positioned over the lower canopy in covering relation to the at least one vent hole; and elastic fastening means for securing the upper canopy between the upper end of the post and the free ends of the ribs with an elastic tautness.

In accordance with another aspect of the present invention, a windproof umbrella includes a post having a lower end to be grasped by a user and an opposite upper end; a plurality of ribs extending outwardly in a radial direction from the upper end of the post; a lower canopy secured in covering relation on the ribs, the lower canopy including at least one vent hole therethrough; channel forming means secured to the lower canopy in surrounding relation to the at least one vent hole for preventing entry of water through the at least one vent hole; and an upper canopy positioned over the lower canopy in covering relation to the at least one vent hole.

In accordance with still another aspect of the present invention, a windproof umbrella includes a post having a lower end to be grasped by a user and an opposite upper end; a plurality of ribs extending outwardly in a radial direction from the upper end of the post; a lower canopy secured in covering relation on the ribs, the lower canopy including at least one lower vent hole therethrough; and an upper canopy positioned over the lower canopy in covering relation to the at least one lower vent hole, the upper canopy including at least one upper vent hole therethrough positioned closer to the free ends of the ribs than the at least one lower vent hole.

In accordance with yet another aspect of the present invention, a windproof umbrella includes a post having a lower end to be grasped by a user and an opposite upper end; a plurality of ribs extending outwardly in a radial direction from the upper end of the post; a lower canopy secured in covering relation on the ribs, the lower canopy including at least one vent hole therethrough; and an upper canopy positioned over the lower canopy in covering relation to the at least one vent hole, the upper canopy including an outer peripheral edge and a plurality of slits extending inwardly in a radial direction from the outer peripheral edge thereof, each slit being arranged generally in line with one rib.

In accordance with a further aspect of the present invention, a windproof umbrella includes a post having a lower end to be grasped by a user and an opposite upper end; a plurality of ribs extending outwardly in a radial direction from the upper end of the post; a lower canopy secured in covering relation on the ribs, the lower canopy including at least one lower vent hole therethrough; bead means secured to the lower canopy in surrounding relation to the at least one lower vent hole for preventing entry of water through the at least one lower vent hole; an upper canopy positioned over the lower canopy in covering relation to the at least one lower vent hole, the upper canopy including at least one upper vent hole therethrough positioned closer to the free ends of the ribs than the at least one lower vent hole, an outer peripheral edge and a plurality of slits extending inwardly in a radial direction from the outer peripheral edge thereof, each slit being arranged generally in line with one rib; and elastic fastening means for securing-the upper canopy between the upper end of the post and the free ends of the ribs with an elastic tautness.

BRIEF DESCRIPTION OF THE DRAWINGS

FIG. 3 is a cross-sectional view of the umbrella of FIG. 1, taken along line 3—3 thereof;

FIG. 6 is an enlarged cross-sectional view of a portion of the umbrella of FIG. 1, taken along line 6—6 thereof;

FIG. 6*a* is a view similar to FIG. 6, but of a modified embodiment;

FIG. 9 is a perspective view of a windproof umbrella according to another embodiment of the present invention, in an assembled, open condition;

FIG. 11 is a cross-sectional view of the umbrella of FIG. 10, taken along line 11—11 thereof;

DETAILED DESCRIPTION

Figure 1:
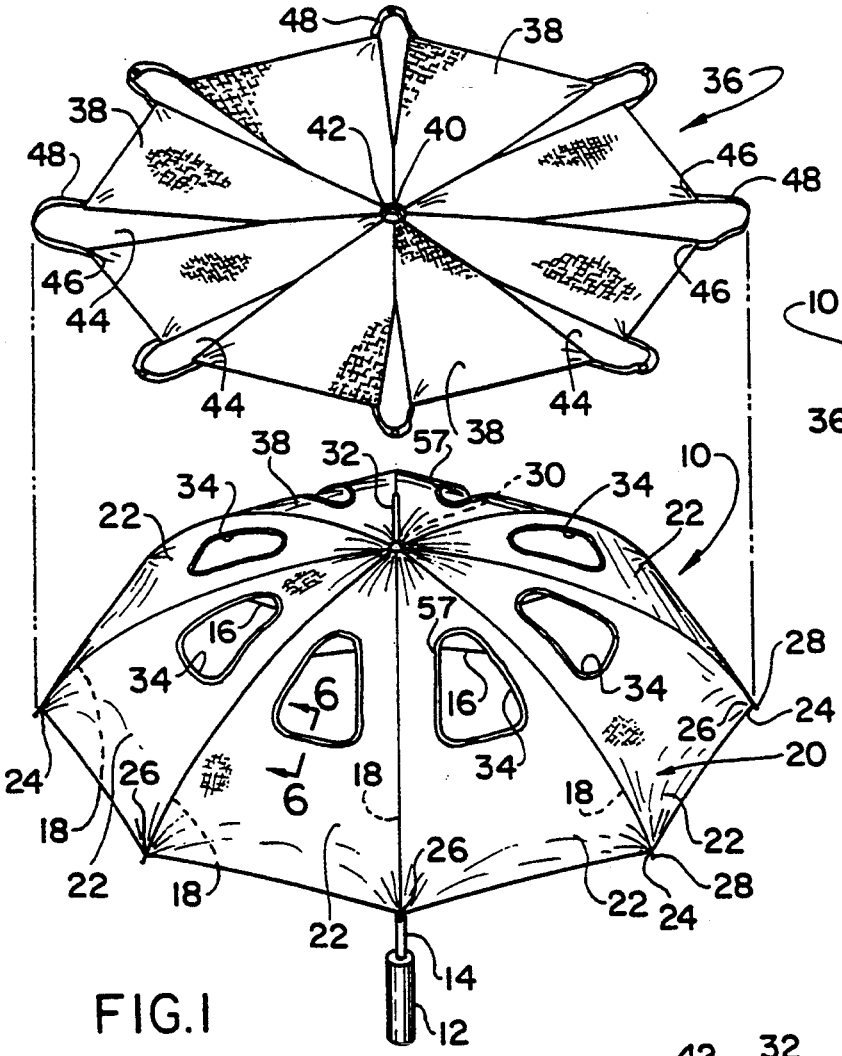
FIG. 1 is an exploded, perspective view of a windproof umbrella according to one embodiment of the present invention, in an open condition.
Figure 4:
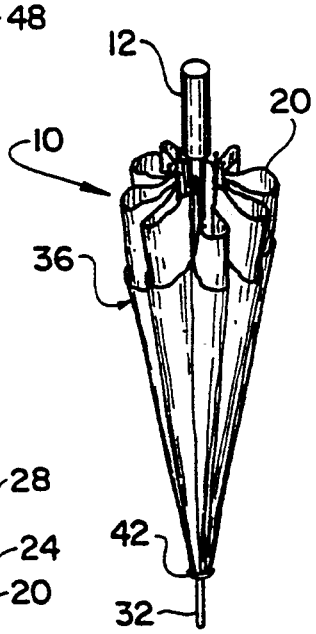
FIG. 4 is a perspective view of the umbrella of FIG. 2, in a closed condition.
Figure 2:
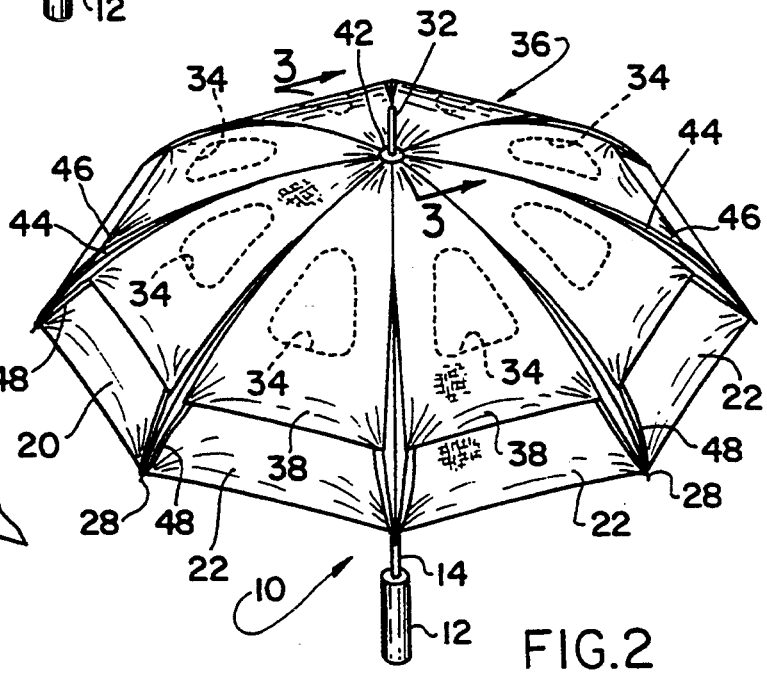
FIG. 2 is a perspective view of the umbrella of FIG. 1, in an assembled, open condition.

Referring to the drawings in detail, and initially to FIGS. 1–6 thereof, a windproof umbrella 10 according to a first embodiment of the present invention includes a center post 14 having a handle 12 secured to the lower end thereof, handle 12 being adapted to be grasped by a user to carry umbrella 10 in its stored position (FIG. 4) and to hold umbrella 10 in its raised, opened position (FIG. 2). A stationary hub 30 is secured at the upper end of center post 14 approximately three inches from the tip thereof so as to provide an upper extension 32 which can be pointed as is conventional and depending on the style of the umbrella.

A plurality of ribs 18 are pivotally connected to hub 30 so as to be equiangularly spaced thereabout and extend outwardly in a radial direction therefrom. In addition, a sleeve 15 is slidably mounted on center post 14 between handle 12 and stationary hub 30 and can be locked in an intermediate position shown in FIG. 3 by a spring biased locking tab 17, as is conventional. A plurality of reinforcing struts 16, equal in number to ribs 18, are provided such that each reinforcing strut 16 is pivotally secured at one end to sleeve 15 and at its opposite end to a respective rib 18 at a position substantially midway therealong. There are preferably eight reinforcing struts 16 and ribs 18, although this number may vary.

A lower canopy 20 is secured in covering relation on ribs 18, as is also conventional. Lower canopy 20 is made from a water-resistant material (such as nylon cloth) and is preferably constructed from substantially triangular cloth sectors 22 which are cut and sewn together to conform to the spaces between ribs 18. In this manner, when canopy 20 is in its untensioned state, it has an octagonal configuration. Canopy 20 is provided with a central opening 21 which fits tightly over hub 30, with canopy 20 preferably being secured to hub 30. In order to secure canopy 20 to ribs 18, the free end or tip 28 of each rib 18 is provided with an eyelet 24 for receiving a thread which is sewn to a corner 26 of canopy 20. In this manner, the peripheral edge of canopy 20 is secured to free ends 28 of ribs 18. Specifically, corners 26 of canopy 20 correspond to the seam lines between sectors 22. Further, the seam between sectors 22 is preferably stitched to each rib 18 at six to eight inch intervals along its length. The above described arrangement is conventional. Generally, because of the dimensions of canopy 20 and ribs 18 and in view of the connection of reinforcing struts 16, ribs 18 and canopy 20 assume a bowed configuration when umbrella 10 is in its fully opened position, as shown in FIG. 1.

As discussed above, quite frequently a wind will catch the umbrella user unaware and exert a force against the inner surface of canopy 20 which will cause canopy 20 to invert from the position shown in FIG. 1 to an upwardly convex or bowed position. Thus, in accordance with a first aspect of the present invention, a vent hole 34 is provided in each canopy sector 22. Preferably, each vent hole 34 has a substantially triangular configuration with gently surrounded corners, although the present invention is not so limited. In addition, each substantially triangular vent hole 34 preferably has a circumferential dimension at a base thereof of approximately four inches and a radial dimension of approximately six inches. As such, air entering the underside of canopy 20 will exit through vent openings 34 so as to allow relief for the wind pressure that would normally invert umbrella 10.

In order to prevent rain from entering vent holes 34, while simultaneously permitting air to exit from the underside of canopy 20 through vent holes 34, an upper canopy 36 is positioned over lower canopy 20 in covering relation to vent holes 34. Upper canopy 36 is preferably comprised of the same water-resistant material as lower canopy 20 and is made from a corresponding number of sectors 38 as lower canopy 20. However, each sector 38 has a dimension in the radial direction of umbrella 10 which is less than that of the corresponding sector 22 of lower canopy 20. Further, as will be made apparent from the discussion hereinafter, the seams connecting sectors 38 are preferably sewn only about one third of the radial length of each sector 38, starting from the center of upper canopy 36, thus leaving a space 44 between peripheral corners 46 of adjacent sectors 38.

A center opening 40 is provided in upper canopy 36 and a grommet 42 is secured thereat and is swaged to sectors 38. Grommet 42 has a center hole and fits snugly on upper extension 32 immediately above stationary hub 30.

Figure 5:
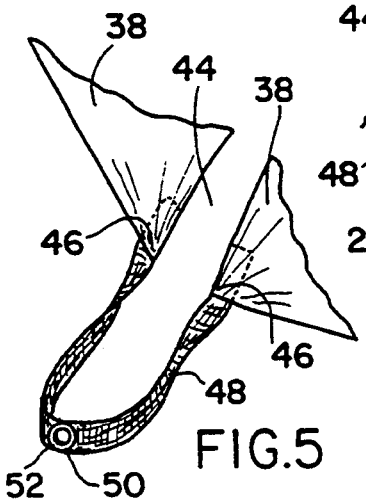
FIG. 5 is an enlarged perspective view of a portion of the umbrella of FIG. 2, showing the elastic straps which secure the upper canopy according to one embodiment of the present invention.

In order to secure the peripheral edge of upper canopy 36 to umbrella 10, a strip of elastic material 48 has opposite ends thereof sewn or otherwise attached to corners 46 of adjacent sectors 38 of upper canopy 36. A fastening means 50, such as a small metal grommet 52, as shown best in FIG. 5, is secured to a midpoint each elastic strip 48. Thus, each grommet 52 is slipped over a respective free end of a rib 18, as shown in FIG. 2. Because of the use of an elastic strip 48, upper canopy 36 is maintained in a slightly taut condition, whether umbrella 10 is in the opened position of FIG. 2 or the closed position of FIG. 4.

As best shown in FIG. 3, during rainy, windy weather, wind 54 that is caught beneath canopy 20 exits through vent holes 34 and applies pressure to the underside of upper canopy 36. This force causes canopy 36 to lift away from lower canopy 20 by means of elastic strips 48 which are slightly stretched to provide a relatively large escape path 56 for wind 54. Wind 54 can then pass through spaces 44 to escape umbrella 10. Thus, any excessive wind 54 will not invert umbrella 10. Further, because of the overlap of upper canopy 36, any rain thereon flows downwardly and outwardly onto the peripheral edges of lower canopy 20 and away from the user. Optionally, with the present invention, it will readily be appreciated that upper canopy 36 may be separated from umbrella 10 so that it can be dried independently thereof. Thus, any water caught between upper canopy 36 and lower canopy 20 may dry in a shorter period of time.

As a further aspect of the present invention, in the event that rain enters the space between upper canopy 36 and lower canopy 20, such rain would tend to fall through vent holes 34 onto the user. Such rain could, for example, possibly enter through grommet 42. In such case, as shown in FIGS. 1, 3 and 6, a bead 57 or other channel forming member can be provided in surrounding relation to each vent hole 34. Such bead 57 can be made of any suitable water-resistant material and could merely be a raised surface in surrounding relation to each vent hole 34. In this manner, beads 57 provide a water channel around the outside of the vent holes 34, and prevent any water from entering vent holes 34 and falling on the user during a particularly heavy rain. Specifically, any water that enters the upper part of the space between upper canopy 36 and lower canopy 20 rolls down lower canopy 20 and hits beads 57. Thereafter, the water travels about beads 57 to the peripheral edge of lower canopy 20. FIG. 6*a* shows another embodiment of a channel forming member 57*a* surrounding a vent hole 34.

Figure 7:
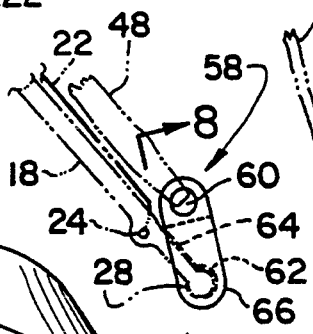
FIG. 7 is a side elevational view of an upper canopy securing device according to another embodiment of the present invention.
Figure 8:
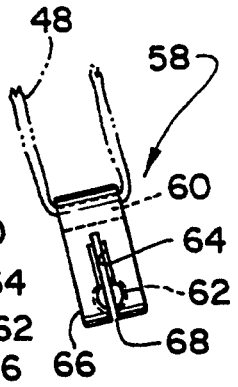
FIG. 8 is a front elevational view of the canopy securing device of FIG. 7, viewed along line 8—8 thereof.

Referring now to FIGS. 7 and 8, an alternative structure for securing upper canopy 36 to the free ends or tips 28 of ribs 18 will now be described. As shown, a securing device 58, which is preferably made of a suitable plastic material has a generally oval configuration. A transverse bore 60 extends through the upper end of securing device 58 for receiving an elastic strip 48 therethrough. The opposite end of securing device 58 is pivotally secured to the free end or tip 28 of a respective rib 18. In this regard, a spherical seat 62 is provided at the lower end of securing device 58 so as to fit snugly over the rounded tip 28 of a rib 18. A groove 64 which is in communication with spherical seat 62 extends upwardly toward transverse bore 60, but stops short thereof. In addition, the lower end 66 of securing device 58 is bifurcated, at 68. In this manner, the lower end 66 of securing device 58 can be biased slightly apart to receive the spherical tip 28 of a rib 18 and upon release of the separating pressure, the spherical tip 28 of such rib 18 is pivotally held captive within spherical seat 62. In such case, when an excessive wind pressure exits through vent openings 34, the elasticity of the material of upper canopy 36, combined with the pivoting nature of securing device 58 at the free end 28 of each rib 18, provides for the raising of upper canopy 36, as shown in FIG. 3, to permit wind 54 to exit from vent holes 34 without inverting umbrella 10.

Referring now to FIG. 9, a windproof umbrella 110 according to another embodiment of the present invention will now be described, in which elements corresponding to those of umbrella 10 are identified by the same reference numerals, augmented by 100, and a detailed description thereof will be omitted herein for the sake of brevity. Windproof umbrella 110 is identical to windproof umbrella 10 of FIGS. 1–6, with the exception that each sector 138 has a flap 70 which is adapted to overlap the adjacent sector 138 so as to completely cover space 44. In this regard, the peripheral end of each flap 70 has a female snap element 72 at its underside which is adapted to engage a respective male snap element 74 of the adjacent sector 138 in order to secure flaps 70 in covering relation to spaces 44. Velcro (trademark) or other hook-and-loop fasteners, or other operable fasteners may be used in place of snap elements 72, 73. In such case, rather than the wind utilizing the escape path 56 shown in FIG. 3 through spaces 44, the wind 54 will tend to escape from the peripheral edge of upper canopy 136 when the flaps 70 are secured in their closed condition.

Figure 10:
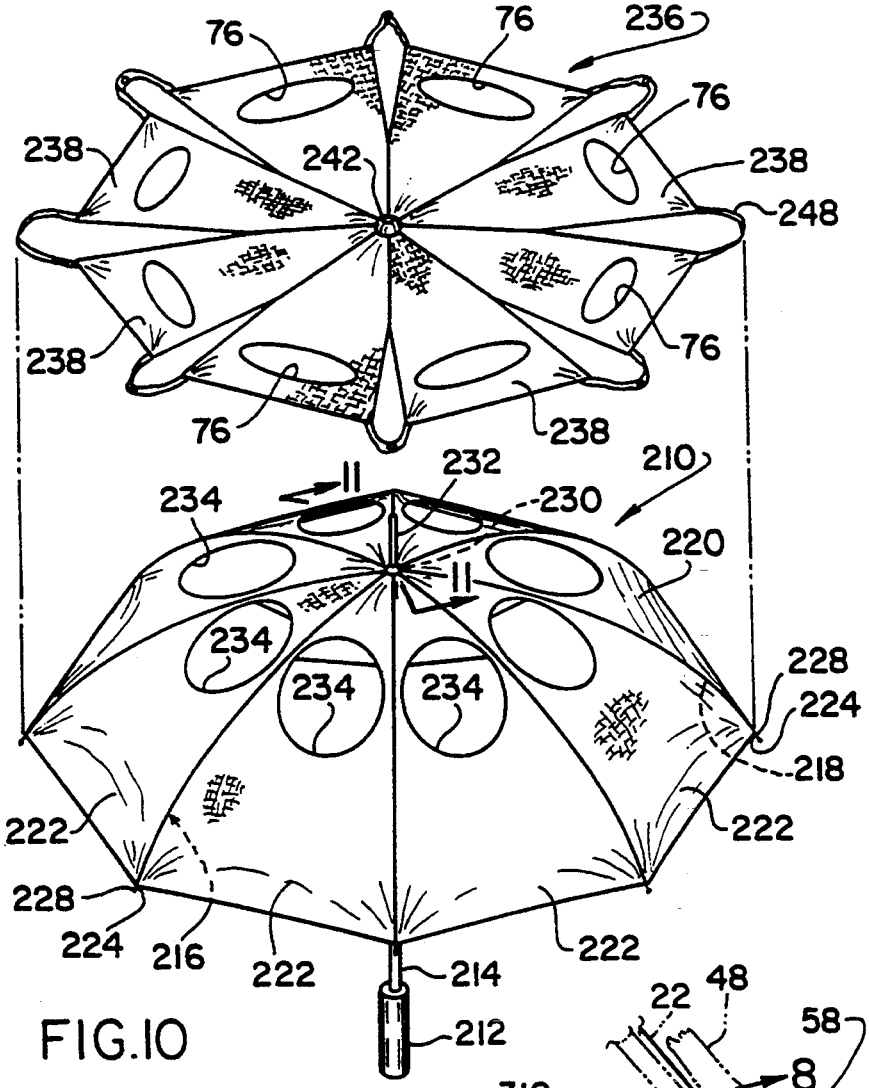
FIG. 10 is an exploded, perspective view of a windproof umbrella according to still another embodiment of the present invention, in an open condition.

Referring now to FIGS. 10 and 11, a windproof umbrella 210 according to another embodiment of the present invention will now be described, in which elements corresponding to those described above with respect to umbrella 10 of FIGS. 1–6 are identified by the same reference numerals, augmented by 200, and a detailed description thereof will be omitted herein for the sake of brevity. As shown, vent holes 234 have a substantially circular or slightly oval configuration and are positioned radially inwardly with respect to vent holes 34 such that ribs 218 are substantially tangent to vent holes 234. Further, upper canopy 236 includes openings 76 which are elongated in the circumferential direction thereof and are positioned radially outward from vent holes 234 when upper canopy 236 is positioned over lower canopy 220. Openings 76 and canopy 236 work in conjunction with vent holes 234 of lower canopy 220 to permit a maximum venting of trapped wind 254 along path 256 as shown best in FIG. 11. As with vent holes 34, vent holes 234 can be made with a bead or channel forming member (not shown) similar to bead 57 or 57*a* in FIGS. 6 or 6*a*. It will be appreciated that any rain that enters openings 76 merely falls on lower canopy 220 at a position radially outward from vent holes 234 and thereby does not enter vent holes 234.

Figure 12:
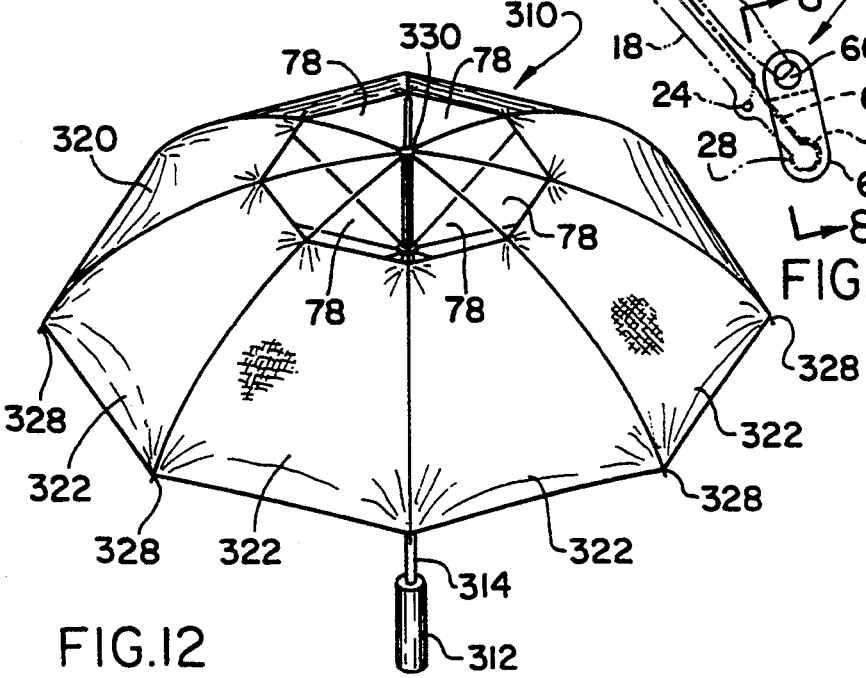
FIG. 12 is a perspective view of a windproof umbrella according to yet another embodiment of the present invention, in an assembled, open condition.

Referring now to FIG. 12, a windproof umbrella 310 according to yet another embodiment of the present invention will now be described, in which elements corresponding to those described above with reference to umbrella 10 of FIGS. 1–6 are identified by the same reference numerals, augmented by 300, and a detailed description thereof will be omitted herein for the sake of brevity. As shown, the substantially triangular vertex 78 of each sector 322 is removed to form a central octagonal cutaway portion of canopy 320. Preferably, the cutaway vertices 78 extend approximately one quarter of the distance of canopy 320 in the radial direction along the ribs from hub 330 to the free end 328 thereof.

Any of the elastically connected upper canopies 36, 136 or 236 can be used therewith.

Figure 13:
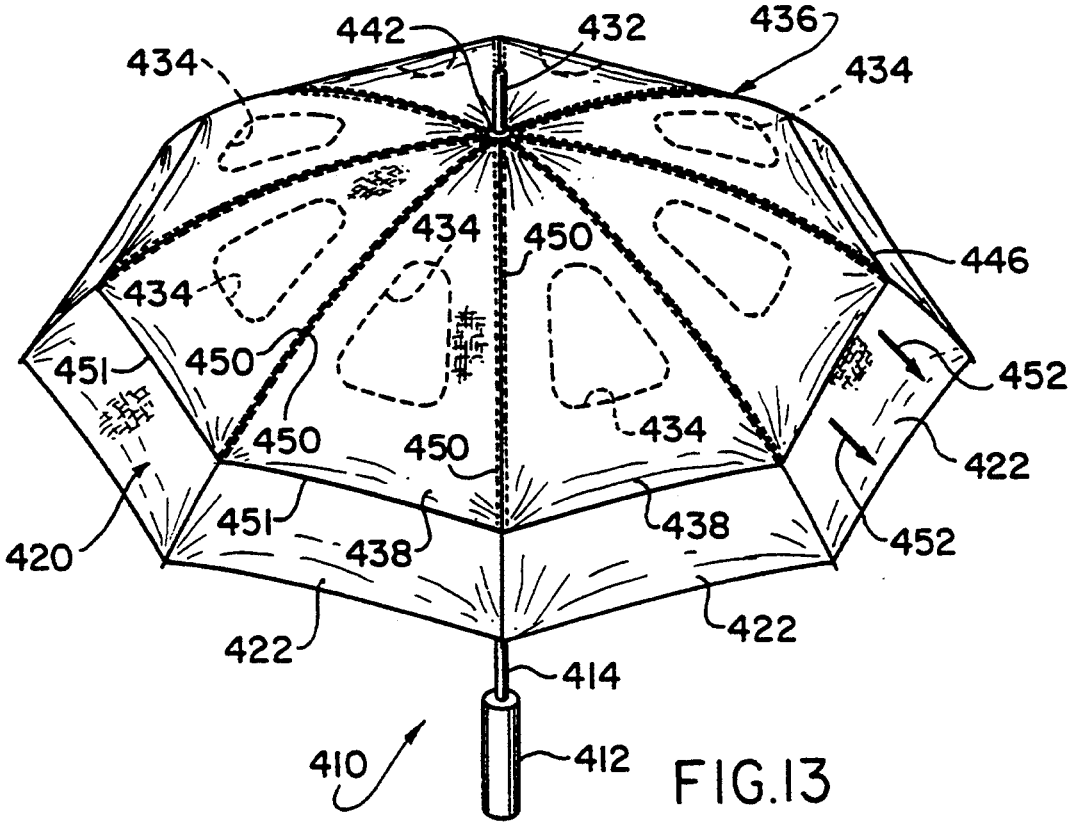
FIG. 13 is a perspective view of a windproof umbrella showing a further embodiment of the present invention, in an assembled, open condition.

FIG. 13 illustrates another embodiment of a windproof umbrella 410. Elements in FIG. 13 corresponding to elements described with reference to the umbrella of FIGS. 1–6 are identified by the same reference numerals, augmented by 400, and a detailed description thereof will be omitted. In FIG. 13, instead of the upper canopy 436 being connected to the ribs 18 by means of elastic members 48 (FIGS. 1 and 2), the upper canopy 436 is connected to the lower canopy 420 by means of stitching 450 preferably in the vicinity of the ribs 18 of the umbrella. Due to the resiliency of the fabric forming the lower canopy 420 and the upper canopy 436, and the resiliency of the ribs 18 of the umbrella, a sufficient air passageway is provided when wind, entering the openings 434 from inside the umbrella and exiting the openings 434 between the upper and lower canopies, to enable the wind to exit through the opening produced between the lower portion 451 of the upper canopy between the stitchings 450 due to flexure of the canopies 420, 436. The exiting of air is indicated by the arrows 452 on one panel of the umbrella, it being clear that the exiting is also carried out through all of the panels of the umbrella having the openings 434 formed therein.

In accordance with the invention, the stitching 450 can be made with a relatively inelastic thread, such as cotton or nylon thread, or may be made by means of an elastic thread so as to provide additional resiliency to the connection between the upper and lower canopies. Preferably, the stitching 450 extends over the complete extent of the upper canopy 436 along the vicinity of the ribs 18, as shown in FIG. 13. However, the upper canopy 430 can be stitched or otherwise connected to the lower canopy 420 only in the vicinity of the end areas 438 of the upper canopy, also in the area of the ribs 18. To improve exiting of air, the upper canopy 436 can be made of a fabric having elasticity, such as an elastic-type waterproof fabric.

Figure 14:
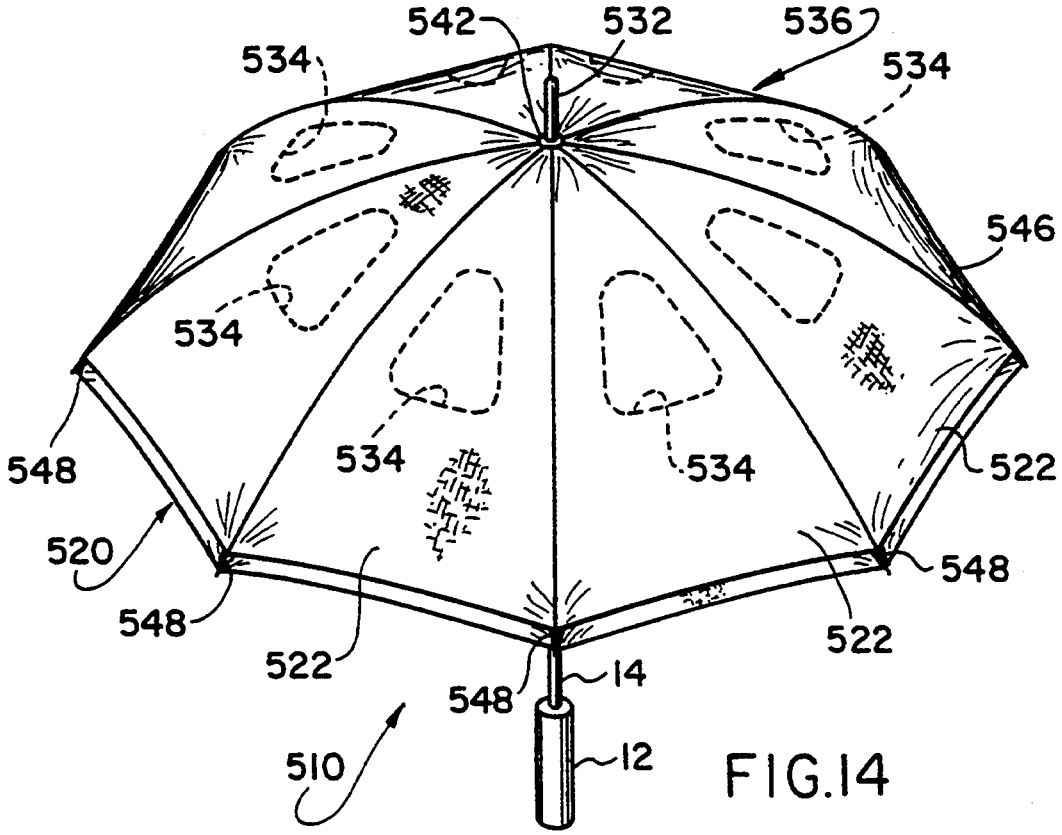
FIG. 14 is a perspective view of a windproof umbrella according to another embodiment of the present invention in an assembled, open condition.

FIG. 14 illustrates an embodiment similar to that of FIGS. 1 and 2, except that the upper canopy 536 is substantially coextensive with the lower canopy 520, the end portions of the upper canopy 536 in the vicinity of the ribs 18 being connected to the ends of the ribs by means of an elastic member 548, as schematically indicated in FIG. 14. The elastic member 548 may take the same form as shown by elastic member 48 in FIGS. 1 and 2, or make take any other suitable form, as desired. A critical factor is that the end portions of the upper canopy 536 in the vicinity of the ribs 18 are connected to the rib ends by means of an elastic member schematically shown at 548 so as to provide additional resiliency in the connection between the upper canopy 536 and the lower canopy 520.

Figure 15:
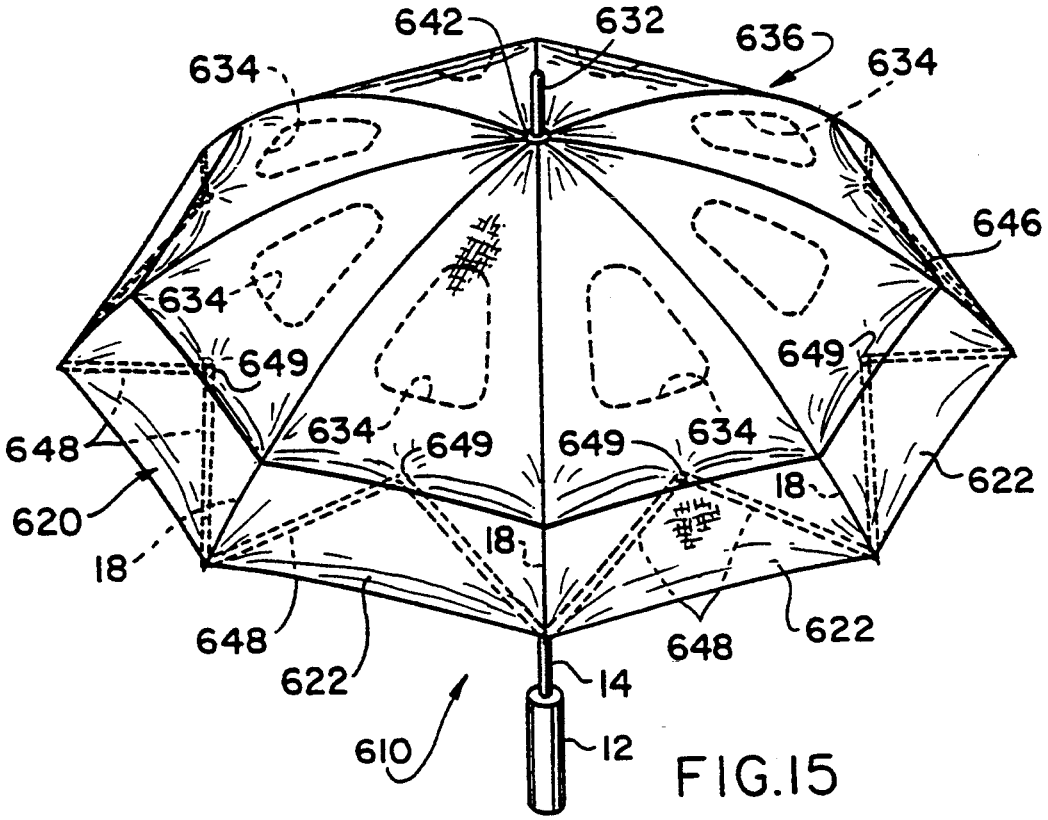
FIG. 15 is a perspective view of a windproof umbrella according to still another embodiment of the present invention, in an assembled, open condition.
Figure 15A:
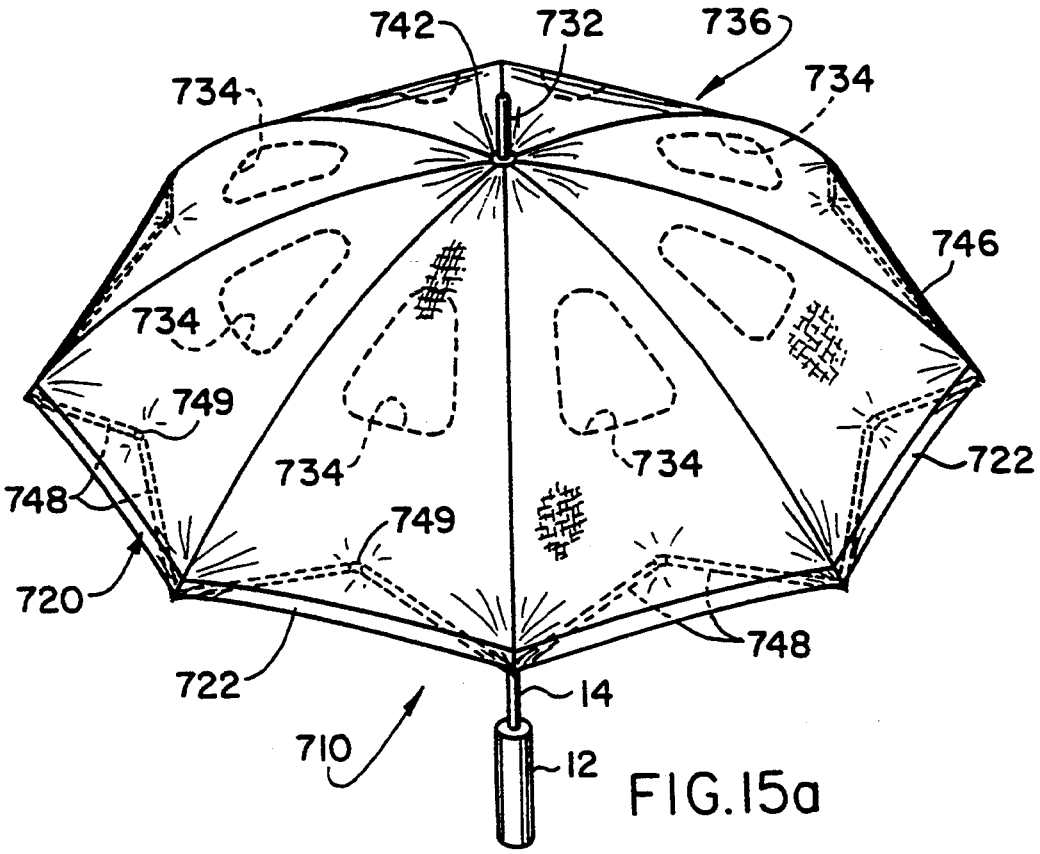
FIG. 15A is a perspective view of a windproof umbrella similar to that of FIG. 15.

FIGS. 15 and 15A illustrate further embodiments of the invention wherein the lower portion of the upper canopy 636 is connected to the tip ends of the ribs 18 by means of elastic members 648. In FIG. 15, the reference numerals used in FIGS. 1 and 2 are augmented by 600, whereas in FIG. 15A the reference numerals are augmented by 700.

In FIG. 15, when wind blows from inside the umbrella, and out through the openings 634, the wind tends to separate the upper canopy 636 from the lower canopy 620. The elastic members 648 are connected to the upper canopy 636 at portions 649, for example by stitching. The elastic members 648 then pass through a small opening in the lower canopy 620 so as to pass inside of the lower canopy 620 and are then connected to the ends of the ribs 18 by means of connecting members such as shown in FIG. 5 or in other drawings of the present application. The small opening in the lower canopy, through which members 648 pass, is below or under the upper canopy 636 to prevent rain water from dripping therethrough. Alternatively, the ends of the elastic members 648 may be connected to end portions of the lower canopy 620 adjacent the tips of the ribs 18 by means of stitching or other adhesive or connecting means. With the embodiment of FIG. 15, when the wind tends to separate the outer canopy 636 from the inner canopy 20, the members 648 are pulled by virtue of their connection at 649 to the outer canopy 636, thereby tending to pull the tip ends of the ribs 18 inward, thus tending to prevent the ribs 18 from being blown and bent outward, thereby further preventing the undesired inversion of the umbrella due to wind.

FIG. 15A is similar in structure, but the upper canopy 736 is substantially coextensive with the lower canopy 720. Connecting elements 748 are similar to connecting elements 648 in FIG. 15, and are connected to the upper canopy 736, for example by means of stitching, at 749 in FIG. 15A. Operation of this embodiment is substantially the same as that of FIG. 15, but it is presently believed by the inventors that the embodiment of FIG. 15 is more effective in preventing inversion of the umbrella because the vent holes are closer to the air exit at the perimeter of the upper layers of fabric.

Figure 16:
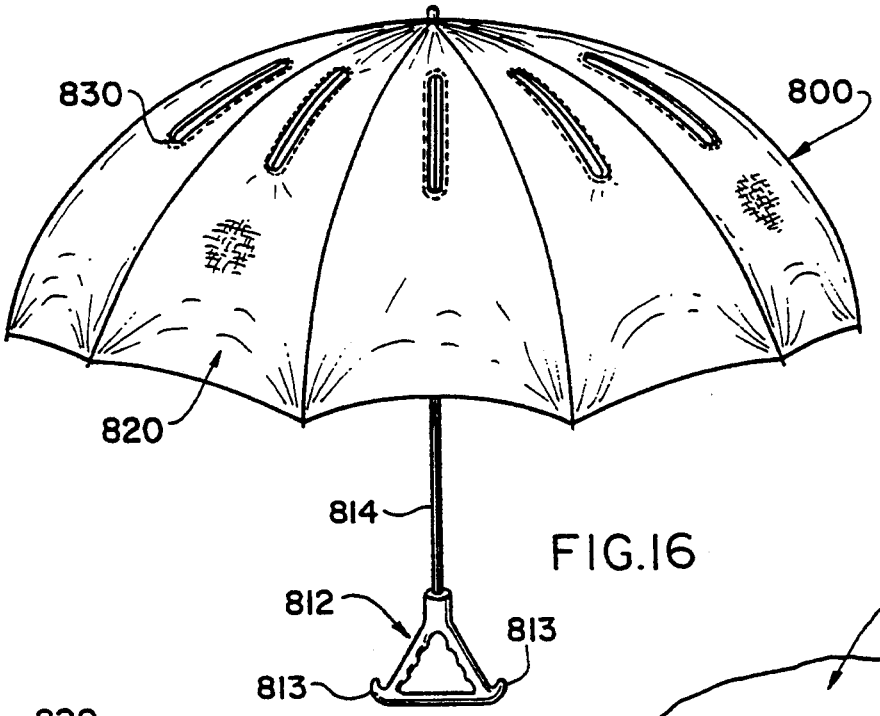
FIG. 16 is a perspective view of still another windproof umbrella according to the present invention in an assembled, open condition.

FIG. 16 illustrates an umbrella 800 having a single layer canopy 820 having self closing elongated vent members 830 mounted therein. The ribs and support structure may be as shown in FIGS. 1 and 2. The self closing vent members 830 are shown in FIG. 16 as being in the vicinity of the upper portion of the canopy 820, and will be described in detail hereinbelow with respect to FIGS. 17–19. The self closing vent members 830 are preferably elongated (as shown) with a narrow profile to facilitate closing the umbrella. The umbrella of FIG. 16 has a center post or shaft 814 with a handle 812 connected to the lower portion thereof. The handle has a triangular shaped member having a center opening for easy gripping by a user with various different orientations of the hand of the user relative to the handle 812. This improves handling and using of the umbrella. The handle 812 also has hook members 813 formed thereon which can be used to hang bags, small packages, or the like while carrying the umbrella, thereby facilitating carrying both the umbrella and small bags, packages or the like at the same time. The handle is preferably made of a plastics material and may be reinforced (i.e., with graphite) for strength.

Figure 17:
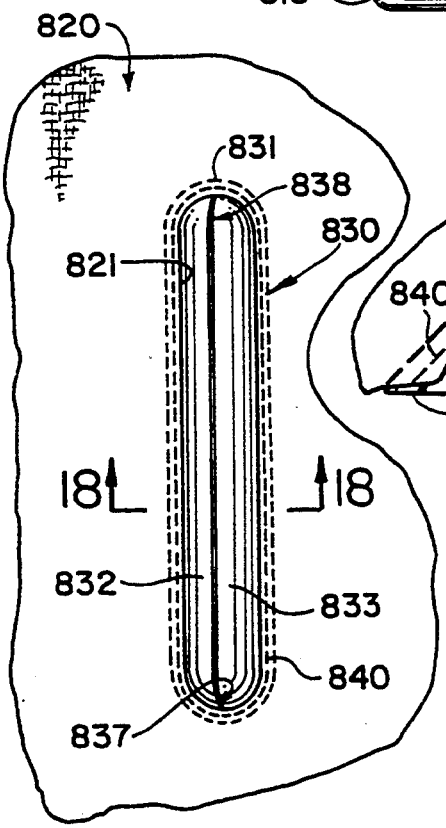
FIG. 17 is an enlarged view showing a wind-openable valve-type mechanism used in the embodiment of FIG. 16.
Figure 18:
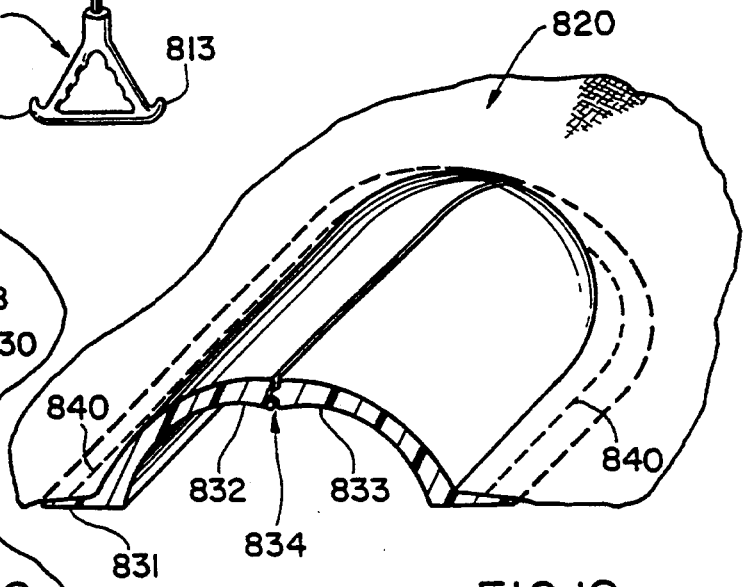
FIG. 18 is a sectional view taken along line 18—18 in FIG. 7, showing the valve in its closed state.

FIG. 17 shows the vent members 830 in an enlarged manner and illustrates how they are connected to the canopy 820 of the umbrella. The vent member 830 has a flange 831 extending therearound, as shown in FIG. 18. The flange 831 is preferably mounted inside of the canopy of the umbrella in the vicinity of a suitably sized cut-out or opening 821 of the canopy 820. The flange 831 of the vent member 830 is connected to the canopy 820 by means of, for example, stitching 840. Alternatively, the vent member flange 831 can be secured to the material of the canopy 820 by means of, for example, an adhesive, or it can be heat-sealed thereto, depending upon materials used. The vent member further has a pair of elongated partly dome-shaped members 832, 833 which together form an elongated dome with an elongated slit as shown in FIG. 18. The end surface portions of the members 832, 833 form an interlocking slit-like structure, as shown for example, at 834 in FIG. 18. In this example, member 833 has a protrusion along the edge thereof, and member 832 has a recess extending therealong, which matingly receives the elongated protrusion on member 833, to provide a substantially water-tight seal when the vent member 830 is in the normal closed position as shown in FIGS. 17 and 18. Any other suitably seal between members 832, 833 could be used, but a male-female interengaging arrangement is preferred. The vent member 830 is preferably a one-piece molded member made of flexible, resilient plastics material having spring-like characteristics, such as polyurethane, silicone rubber or the like.

Figure 19:
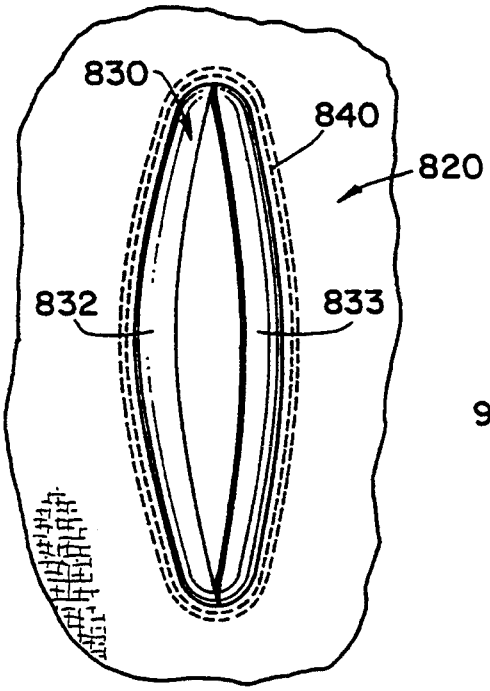
FIG. 19 is an enlarged view, similar to FIG. 17, showing the valve member in the open state while wind is passing therethrough.

In use, when wind blows from the inside of the umbrella, the dome-shaped members 832, 833 are forced to separate (by the force of the wind) along their releasable mating slit-like interconnection 834 to allow air to pass therebetween, as shown in FIG. 19. When the air pressure is released (i.e., when the wind stops blowing), the members 832, 833 return quickly and automatically to their closed positions, such as shown in FIGS. 17 and 18, due to the inherent spring-like or resilient characteristic of the material from which the vent member 830 is fabricated. When the wind is of sufficiently high force to open the vent members 830, it is also sufficiently strong to prevent rain from entering through the open vent members 830.

In order to improve the closing of the vent member 830, the elongated slit or opening between the members 832, 833 can be eliminated only at the end portions 827, 838 thereof (i.e., the slit will begin at a point spaced from the ends of member 830). This will, however, also make it more difficult for the wind to open the vent member 830, but it will more quickly and securely close the vent member 830 upon ceasing of blowing of the wind, to thereby improve the water tightness of the umbrella.

Figure 20:
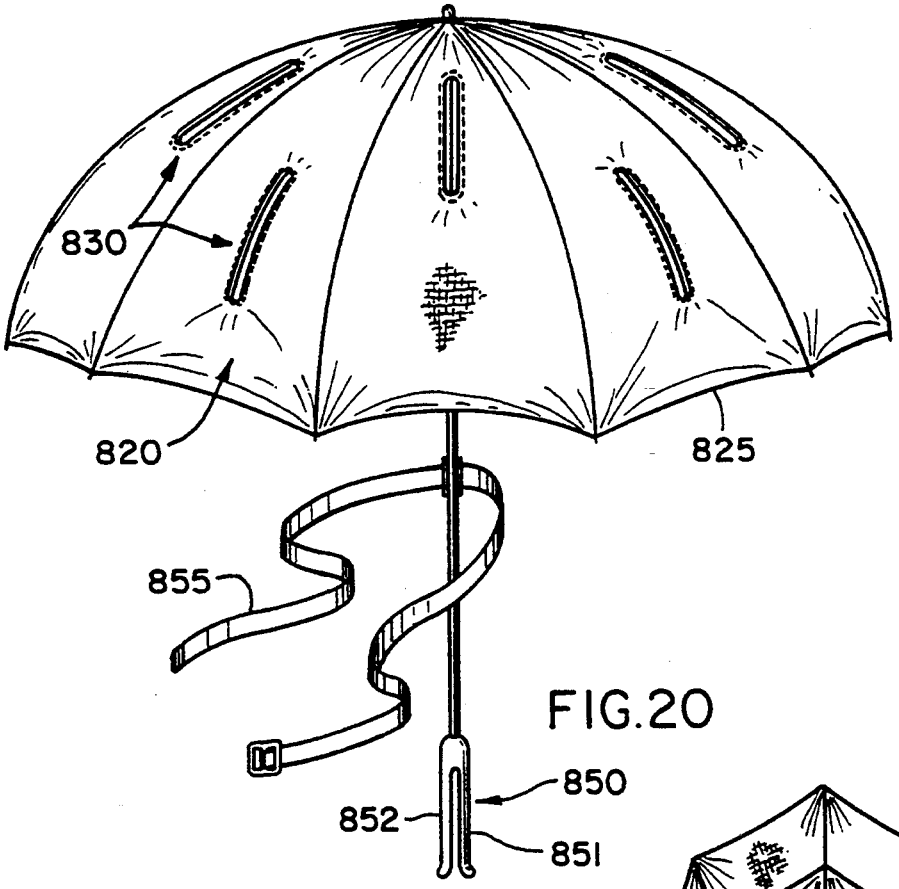
FIG. 20 is a perspective view of a windproof umbrella similar to that of FIG. 16, but showing different locations for the wind-passing valves.

FIG. 20 shows an embodiment similar to that of FIG. 16, using the same vent members 830 of FIG. 16–19, but having different locations of the vent members 830 thereon. The vent members 830 of FIG. 20 are connected to the canopy 820 in the same manner as discussed above with respect to FIGS. 16–19, and the operation is substantially similar. However, it is believed that by providing additional vent members toward the lower portions 825 of the canopy 820, the effectiveness of the apparatus is improved.

The embodiment of FIG. 20 incorporates a handle 850 formed of a prong-like or bifurcated member having separated legs 851, 852 which can be slipped over a belt or the like of a user, to render the umbrella substantially self-supporting. A belt or strap 855 is provided for further securing the umbrella to the body of the user, for example over a shoulder, to render the umbrella more easily supported by the user and to free the hands of the user.

Figure 21:
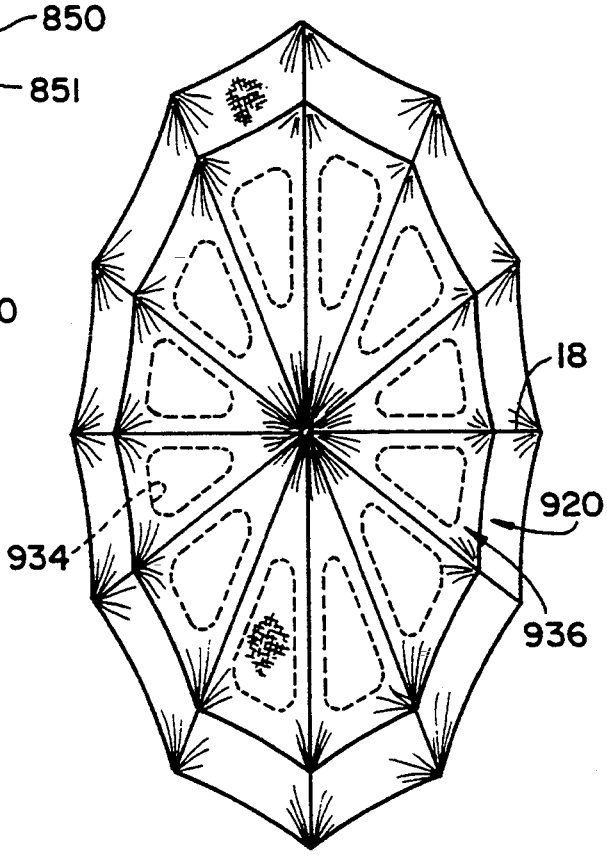
FIG. 21 is a top view of an oval-shaped windproof umbrella according to the present invention.

FIG. 21 illustrates a top view of an embodiment constructed along the lines of the invention, but which is oval in shape as seen in top view. FIG. 21 is a top view of the umbrella in its open condition, showing that it has a reduced side-to-side dimension, while having an increased front-to-back dimension. This makes the umbrella more easily carried in crowds, since the side portions of the umbrella will not extend so far and will not interfere so much with passing pedestrians or the like, and will facilitate passing through doorways or other narrow passageways. This embodiment also increases frontal and back protection from rain, which are the areas most in need of such protection. In the embodiment of FIG. 21, the upper canopy 936 cam be connected to the lower canopy 920 or to the ribs 18 in the same manner as previously described with the embodiments of FIGS. 1–12, or the upper canopy 936 can be connected to the lower canopy by means of stitching similar to stitching 450 shown in FIG. 13. Operation of the embodiment of FIG. 21 is substantially the same as the previously described embodiments. Preferably, the front-to-back dimension exceeds the side-to-side dimension by about 12 inches to about 24 inches.

Figure 22:
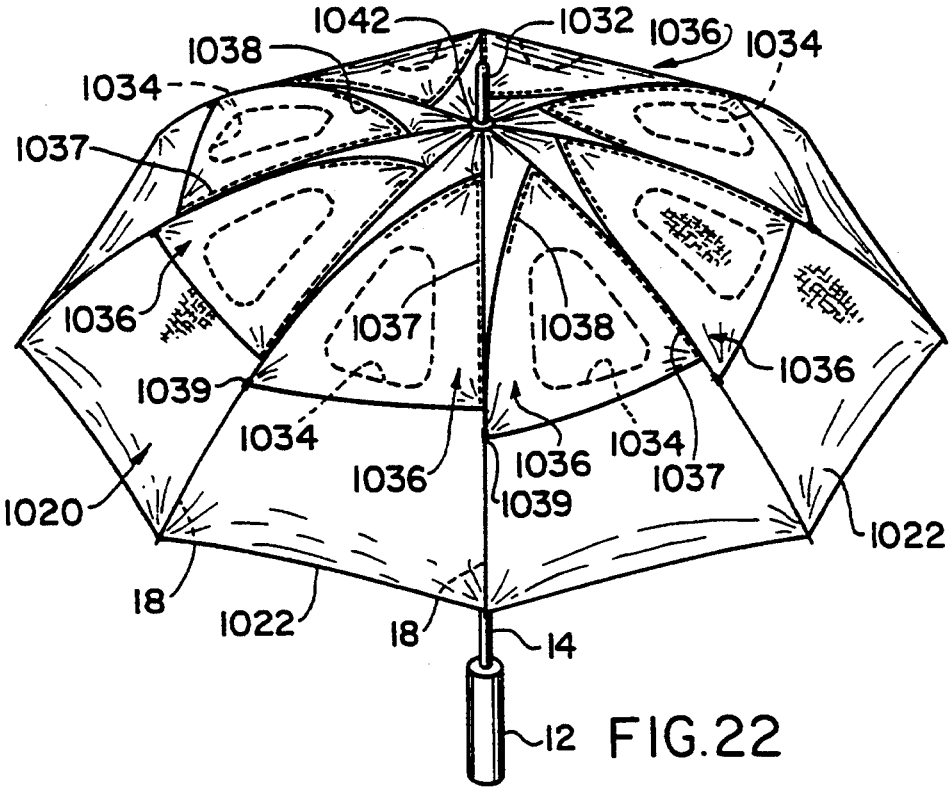
FIG. 22 is a perspective view of a windproof umbrella according to another embodiment of the present invention, in an assembled, open condition.
Figure 22A:
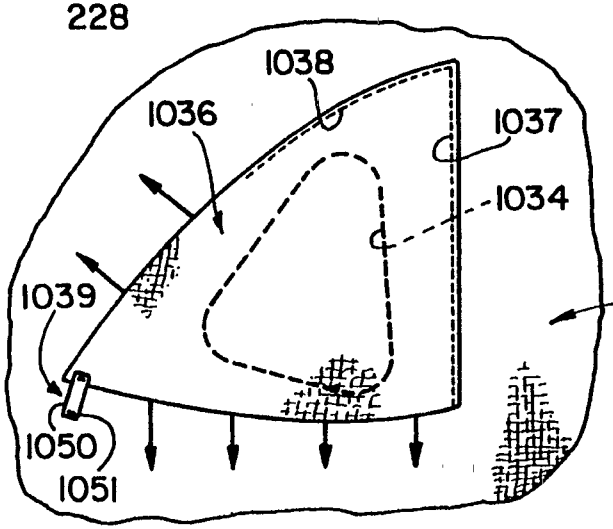
FIG. 22A shows a detail of FIG. 22.

FIG. 22 illustrates an embodiment wherein reference numerals designating the same parts as in FIGS. 1 and 2 are augmented by 1,000. FIG. 22 includes openings 1034 similar to openings 34 of FIGS. 1 and 2, but includes a plurality of flap members 1036 (instead of an upper canopy) secured to the respective panels of the umbrella which incorporate the openings 1034 therein so as to cover the openings 1034. The flap members 1036 are preferably stitched to the lower canopy 1020, as shown by stitching 1037 in FIG. 22. The stitching 1037 preferably extends along one side of the flap 1036 and along at least a portion of the other side of the flap as shown by 1038 to improve water tightness. Stitching, could, however, be only provided along one side 1037 of the flaps 1036, if desired, but this would reduce water tightness. The free or open end of the flaps 1036 opposite the stitching 1037 is secured to the lower canopy 1020 or to the ribs 18 by means of an elastic member, as shown at 1039 in FIG. 22. FIG. 22A illustrates a typical elastic band-type connection 1039, it being clear that other types of elastic or inelastic connections could be provided. As shown in FIG. 22A, the elastic connection 1039 is provided by means of a band of elastic fabric or ribbon 1050 or the like which may be stitched to the flap 1036 and to the lower canopy 1020 by means of stitching 1051 or the like. As mentioned above, the connection 1039 could be inelastic, in which case the connection could be stitching (or other connection) of the lower left corner of the triangular flap 1036 directly to the lower canopy 1020 or directly to the rib 18 which passes thereunder. This is a matter of design which may be freely chosen. The wind exits through the openings 1034, and passes between the flaps 1036 and the lower canopy 1020, and exits therebetween, as shown by the arrows in FIG. 22A. The fabric from which the flap 1036 is made is preferably very flexible and waterproof, such as a conventional umbrella canopy fabric, or can be made from a stretchable resilient material, to improve yielding thereof and the passage of air thereunder.

Figure 23:
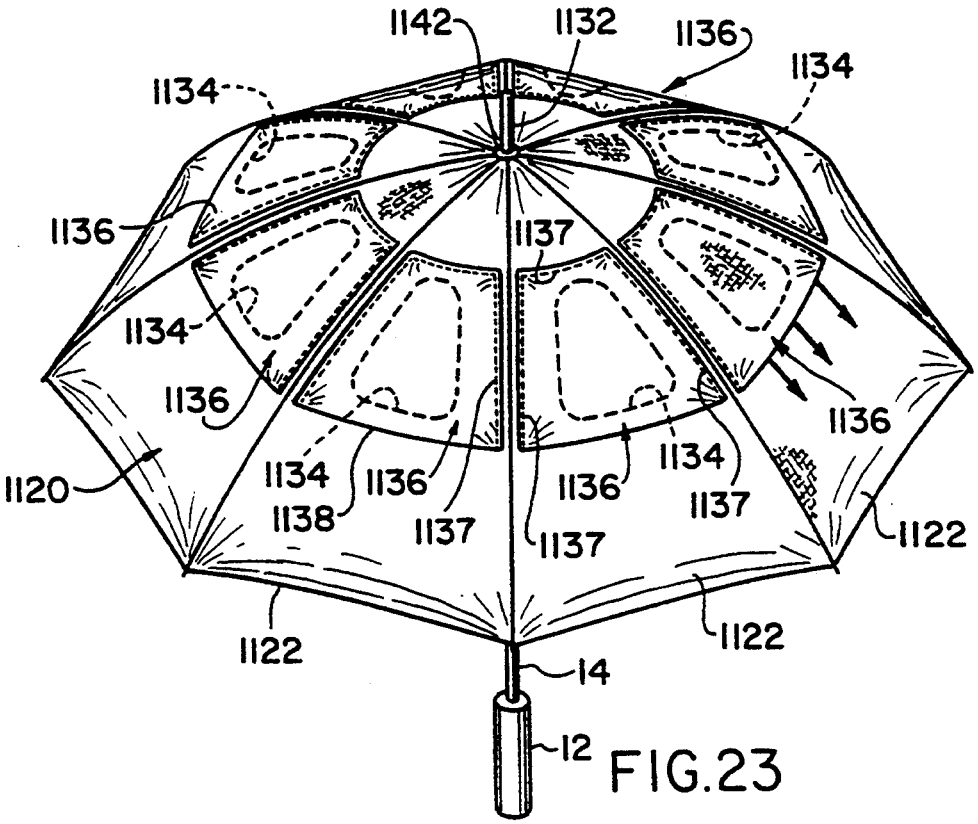
FIG. 23 is a perspective view of a windproof umbrella, similar to that of FIG. 22, in an assembled, open condition.

FIG. 23 is similar to the embodiment of FIG. 22, and the reference numerals for the same elements as in FIGS. 1 and 2 are augmented by 1100. In this embodiment, the flaps 1136 are generally trapezoidal in shape and are stitched or otherwise secured to the lower canopy 1120 by means of stitching 1137 along three sides thereof. The lower edge portions 1138 of the flaps 1136 are unconnected to the lower canopy 1120, and air passes between the flaps 1136 and the lower canopy 1120 through the opening provided by the lower unconnected edges 1138 of the flaps 1136. This air flow is shown by arrows in FIG. 23. The fabric from which the flaps 1136 is made can be the same as in FIG. 22 and may be modified as discussed hereinabove with respect to FIG. 22.

The stitching connections shown in FIG. 22, 22A and 23 can be by means of ordinary thread (non-elastic) or can be by means of elastic thread, so as to provide additional resilience and yieldability, and better operability with respect to air pressure. Alternatively, instead of stitching, adhesive connection (in place of stitching) heat sealing, or other connecting technique could be used, depending upon the materials from which the inner canopy and the outer canopy and/or flaps are made. At present, stitching is preferred.

Figure 24:
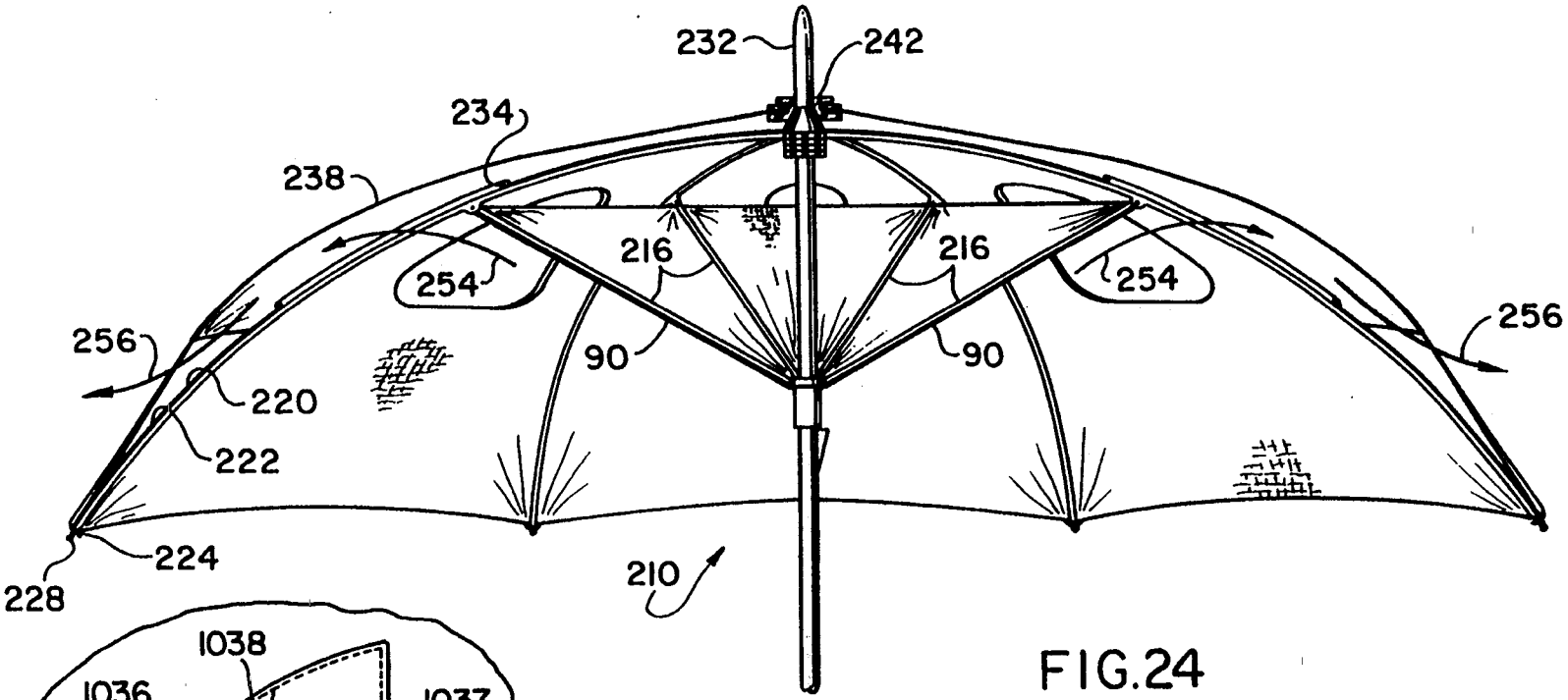
FIG. 24 is a cross-sectional view of the umbrella, similar to that of FIG. 11, but showing a conical airflow directing member internally of the umbrella.

Referring to FIG. 24, which is similar to the showing in FIG. 11, the umbrella of FIG. 24 further comprises an inwardly directed, conical, airflow directing member at the upper part of the umbrella surrounding the center post 14. The reference numbers shown in FIG. 24 are the same as in FIG. 11 for the purpose of description. The conical shaped member 90 in FIG. 24 extends completely around the center post 14, but only half is shown in FIG. 24. The conical member may be made of fabric (for example the same as the fabric of the outer canopies) or any other suitable flexible and resilient sheet-like material. The conical member is preferably secured to the reinforcing struts 16 to provide shape. The connection to the reinforcing struts 16 can be ties with thread or the like, or other suitable means. Since the conical shaped member 90 is made of flexible material, the umbrella can be easily folded in the same manner as a conventional umbrella. The conical shaped member 90 not only provides better directing of the air flow to the vent holes 34 or the like, but also strengthens the structure to help prevent damage thereto, especially when exposed to high winds. The conical member 90 of FIG. 24 can be used with any of the other embodiments shown in the drawings, as should be readily apparent. The illustration in FIG. 24 is exemplary, and is given only by way of example.

The present invention provides various embodiments of windproof umbrellas that prevent inversion of the umbrella while also preventing rain from falling on the user.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A windproof umbrella comprising:

a post having a lower end to be grasped by a user and an opposite upper end;

a plurality of ribs extending outwardly in a radial direction from said upper end of said post, each rib having a free end portion;

a lower canopy secured in covering relation on said ribs, said lower canopy including a plurality of vent holes therethrough, said vent holes being in about a middle portion of said lower canopy between said post and said free end portions of said ribs, and said vent holes being arranged between adjacent ribs;

an upper canopy positioned over said lower canopy in covering relation to all of said vent holes;

said upper canopy extending from said post to an area below said middle portion of said lower canopy and having a lower peripheral edge extending below lower extremities of said vent holes, said upper canopy being held in fixed position in the vicinity of said post;

elastic fastening means including a plurality of elastic strap means for securing said upper canopy to said ribs in the vicinity of said free end portions of said ribs, for thereby securing said upper canopy between said upper end of said post and the vicinity of said free portions of said ribs with an elastic tautness and to permit at least a lower peripheral edge portion of said upper canopy to elastically separate from said lower canopy while also covering all said vent holes to prevent rain water from entering said vent holes from above the umbrella.

2. A windproof umbrella according to claim 1, further including hub means secured to the upper end of the post for securing the plurality of ribs to said upper end of said post.

3. A windproof umbrella according to claim 1, further comprising a sleeve slidably positioned on said post between said upper and lower ends thereof, and a plurality of reinforcing struts pivotally secured between said sleeve and said ribs.

4. A windproof umbrella according to claim 1, wherein each of said plurality of elastic strap means are connected in spaced relation about said lower peripheral edge of said upper canopy, each elastic strap means including elastic strap fastening means for securing the respective elastic strap means to the free end portion of one of said ribs.

5. A windproof umbrella according to claim 4, wherein said elastic strap fastening means includes a grommet having a hole therein through which the free end of a respective one of said ribs extends.

6. A windproof umbrella according to claim 4, wherein said elastic strap fastening means includes at least one securing means for pivotally connecting at least one said elastic strap to the free end of said ribs.

7. A windproof umbrella according to claim 6, wherein each said securing means includes a securing device having an upper end with a bore extending therethrough for receiving one of said elastic straps, and a lower end pivotally connected with the free end of one of said ribs.

8. A windproof umbrella according to claim 7, wherein the free end of each said rib is spherical, and the lower end of each said securing device includes a spherical seat for pivotally receiving the spherical free end of one of said ribs.

9. A windproof umbrella according to claim 1, wherein said upper canopy has dimensions less than those of said lower canopy.

10. A windproof umbrella according to claim 1, further comprising channel forming means on said lower canopy in surrounding relation to each of said vent holes for preventing entry of water through each said vent hole.

11. A windproof umbrella according to claim 9, further including hub means secured to the upper end of the post for securing the plurality of ribs to said upper end of said post.

12. A windproof umbrella according to claim 9, wherein said upper canopy is detachably connected to said umbrella in covering relation to said lower canopy.

13. A windproof umbrella according to claim 9, wherein said upper canopy has dimensions less than those of said lower canopy.

14. A windproof umbrella according to claim 1, wherein said elastic fastening means comprises elastic elongated members secured to said upper canopy at an intermediate position between adjacent ribs, and extending through respective openings in said lower canopy, said elastic fastening means being connected at opposite ends thereof to free end portions of said ribs or to said lower canopy in the vicinity of said free end portions of said ribs, to pull said ribs inwardly responsive to air pressure inside of said umbrella passing through said at least one vent hole and tending to force said upper canopy outwardly.

15. A windproof umbrella according to claim 1, further comprising an inwardly directed, conically shaped flexible member surrounding said post and arranged at the upper end of said umbrella so as to direct air flow toward said at least one vent hole.

16. A windproof umbrella according to claim 1, wherein said upper canopy has a plurality of slits therein, said slits extending inwardly in a radial direction from said lower peripheral edge of said upper canopy, and each said slit being arranged generally in line with one said rib.

17. A windproof umbrella according to claim 1, wherein said upper canopy includes at least one upper vent hole therethrough, said at least one upper vent hole being positioned closer to said free end portions of said ribs than said vent holes in said lower canopy.

18. A windproof umbrella according to claim 17, wherein said upper canopy includes a plurality of said upper vent holes therein.

19. A windproof umbrella according to claim 18, wherein said upper vent holes each have an elongated configuration in the circumferential direction of said upper canopy.

20. A windproof umbrella according to claim 11, wherein each said slit extends a distance approximately two-thirds of the way from the outer peripheral edge of said upper canopy to a center point thereof.

21. A windproof umbrella comprising:

a post having a lower end to be grasped by a user and an opposite upper end;

a plurality of ribs extending outwardly in a radial direction from said upper end of said post;

a lower canopy secured in covering relation on said ribs, said lower canopy including at least one lower vent hole therethrough; and an upper canopy positioned over said lower canopy in covering relation to said at least one lower vent hole, said upper canopy including at least one upper vent hole therethrough positioned closer to said free ends of said ribs than said at least one lower vent hole.

22. A windproof umbrella according to claim 21, wherein each said upper vent hole has an elongated configuration in the circumferential direction of said upper canopy.

23. A windproof umbrella according to claim 21, wherein each said lower vent hole has a substantially circular configuration.

24. A windproof umbrella according to claim 21, further including hub means secured to the upper end of the post for securing the plurality of ribs to said upper end of said post.

25. A windproof umbrella according to claim 21, further comprising elastic fastening means for securing said upper canopy between an upper end of said post and free ends of said ribs, with an elastic tautness.

26. A windproof umbrella according to claim 21, wherein said upper canopy is detachably connected to said umbrella in covering relation to said lower canopy.

27. A windproof umbrella according to claim 21, wherein said upper canopy has dimensions less than those of said lower canopy.

28. A windproof umbrella comprising:

a post having a lower end to be grasped by a user and an opposite upper end;

a plurality of ribs extending outwardly in a radial direction from said upper end of said post;

a lower canopy secured in covering relation on said ribs, said lower canopy including at least one lower vent hole therethrough;

channel forming means secured to said lower canopy in surrounding relation to said at least one lower vent hole for further preventing entry of water through said at least one lower vent hole;

an upper canopy positioned over said lower canopy in covering relation to said at least one lower vent hole, said upper canopy including at least one upper vent hole therethrough positioned closer to said free ends of said ribs than said at least one lower vent hole, an outer peripheral edge and a plurality of slits extending inwardly in a radial direction from the outer peripheral edge thereof, each said slit being arranged generally in line with one said rib; and elastic fastening means for securing said upper canopy between said upper end of said post and said free ends of said ribs with an elastic tautness.

29. A windproof umbrella according to claim 28, further including hub means secured to the upper end of the post for securing the plurality of ribs to said upper end of said post.

30. A windproof umbrella according to claim 28, further comprising elastic fastening means for securing said upper canopy between an upper end of said post and free ends of said ribs, with an elastic tautness.

31. A windproof umbrella according to claim 28, wherein said upper canopy is detachably connected to said umbrella in covering relation to said lower canopy.

32. A windproof umbrella according to claim 28, wherein said upper canopy has dimensions less than those of said lower canopy.

* * * * *